US007581805B2

(12) United States Patent
Furukawa

(10) Patent No.: US 7,581,805 B2
(45) Date of Patent: Sep. 1, 2009

(54) RECORDING HEAD AND RECORDING APPARATUS

(75) Inventor: Tatsuo Furukawa, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 11/460,368

(22) Filed: Jul. 27, 2006

(65) Prior Publication Data

US 2006/0256152 A1 Nov. 16, 2006

Related U.S. Application Data

(63) Continuation of application No. 10/903,635, filed on Jul. 30, 2004, now Pat. No. 7,125,093.

(30) Foreign Application Priority Data

Jul. 31, 2003 (JP) ..... 2003-204814

(51) Int. Cl.
*B41J 29/38* (2006.01)
*B41J 29/393* (2006.01)

(52) U.S. Cl. ..... 347/17; 347/19; 347/49

(58) Field of Classification Search ..... 347/17
See application file for complete search history.

(56) References Cited

U.S. PATENT DOCUMENTS 4,125,845 A * 11/1978 Stevenson, Jr. ..... 347/17
4,559,565 A 12/1985 Katsuragi et al.
4,723,129 A 2/1988 Endo
4,740,796 A 4/1988 Endo
5,287,063 A 2/1994 Izawa
5,606,271 A 2/1997 Van Lammeren et al.
5,838,341 A 11/1998 Hiwada
5,896,050 A 4/1999 Shinohara et al.
6,243,109 B1 * 6/2001 Ishinaga et al. ..... 347/5
6,290,334 B1 9/2001 Ishinaga et al.
6,322,189 B1 11/2001 Anderson et al.
6,641,243 B2 11/2003 Anderson et al.
6,755,580 B2 6/2004 Furukawa et al.
2002/0027574 A1 * 3/2002 Kao et al. ..... 347/17
2002/0130913 A1 * 9/2002 Murata ..... 347/14
2004/0119770 A1 * 6/2004 Tamura ..... 347/19

FOREIGN PATENT DOCUMENTS

JP 01209161 A * 8/1989

* cited by examiner

*Primary Examiner*—Matthew Luu
*Assistant Examiner*—Shelby Fidler
(74) *Attorney, Agent, or Firm*—Canon USA Inc IP Div

(57) ABSTRACT

A recording-head substrate including a recording element, a driving circuit for driving the recording element, a temperature-detecting element for measuring the temperature of the recording-head substrate by outputting at least one of a maximum output voltage and a minimum output voltage, a first detection circuit for detecting the maximum output voltage from the temperature-detecting element, a second detection circuit for detecting the minimum output voltage from the temperature-detecting element, and first and second output terminals coupled to the first and second detection circuits for outputting the maximum and minimum output voltages respectively.

3 Claims, 13 Drawing Sheets

RECORDING HEAD AND RECORDING APPARATUS

CROSS REFERENCE TO RELATED APPLICATIONS

This application is a continuation of patent application Ser. No. 10/903,635 filed Jul. 30, 2004, which claims the benefit of Japanese Application 2003-204814, filed Jul. 31, 2003, both of which are incorporated by reference herein in their entirety.

BACKGROUND OF THE INVENTION

1. Field of the Invention

The present invention relates to image recording apparatuses, and more particularly to a recording head having a recording-head substrate.

2. Description of the Related Art

In recording heads mounted in conventional ink-jet recording apparatuses, electrothermal transducers (heaters) and driving circuits are provided integrally on a substrate by a semiconductor process technology, such as that disclosed in U.S. Pat. No. 6,290,334.

Furthermore, various techniques have been proposed which detect the state of the substrate. For example, techniques to detect the temperature of a substrate based on an output from a temperature-detecting element provided on the same substrate.

FIG. 11 is a block diagram showing a configuration of a known ink-jet recording-head substrate (hereinafter simply referred to as a "substrate") having a temperature-detecting element.

Referring to FIG. 11, heaters serving as electrothermal transducers for heating and discharging ink, and driving circuits therefor are provided integrally with an ink-jet recording-head substrate 100 by a semiconductor process technology. The ink-jet recording-head substrate 100 includes driver and heater arrays 101 in which a plurality of heaters and driver circuits are arranged, an ink supply channel 102 for supplying ink from the back side of the substrate 100, shift registers (S/R) 103 for temporarily holding external input recording data, input circuits 104 including buffer circuits for inputting digital signals from the recording apparatus to the shift registers 103, and decoder circuits 107 (which will be described later). The ink-jet recording-head substrate 100 also includes signal lines 105 for sending a signal for selecting any segment of the driver and heater arrays 101 from the shift registers 103 and the decoder circuits 107, the decoder circuits (decoders) 107 for selectively driving a desired heater block of the driver and heater arrays 101, and a temperature-detecting element 120 for detecting the temperature of the substrate 100.

FIG. 12 is an equivalent circuit diagram of a circuit used to drive one heater and one driver (one segment) in order to supply a current to the heater for ink discharging.

The circuit shown in FIG. 12 includes an AND circuit 901 for obtaining an AND between a block select signal (block select) sent from the decoder circuit 107 to select heaters from a plurality of blocks, and recording data (bit select) transferred to the shift register 103 and then held according to a latch signal in order to selectively drive the heaters, an inverter circuit 902 for buffering an output from the AND circuit 901, a power line (VDD) 903 serving as a power supply for the inverter circuit 902, a power line (VHT) 904 serving as a power supply connected to an inverter circuit 908 (which will be described later) in order to supply a gate voltage for a driver transistor 907 (which will be described later), a power line (VH) 905 serving as a power supply for heater driving, a heater 906, the driver transistor 907 for applying a current to the heater 906, and the inverter circuit 908 serving as a buffer that receives an output from the inverter circuit 902.

FIG. 13 is an equivalent circuit diagram of a circuit corresponding to one bit of a shift register (S/R) that temporarily stores recording data and a latch circuit.

FIG. 14 is a timing chart showing a series of operations of transferring recording data to a shift register (S/R) and of applying a current to a heater.

In synchronization with a clock pulse (CLK) input to a terminal 1001 shown in FIG. 13, recording data (DATA) is supplied to a terminal 1003. A shift register temporarily stores the recording data, and a latch circuit holds the recording data according to a latch signal (BG) applied to a terminal 1005. When the clock pulse and the latch signal are input, inversion signals (ICLK, IBG) corresponding thereto are also input from terminals 1002 and 1004, respectively, in order to ensure high reliability during a high-speed operation.

Subsequently, an AND between a block select signal (block select) for selecting heaters divided in a plurality of blocks and the recording data (DATA) held by the latch signal (BG) is obtained, and a heater current is applied in synchronization with a heat enable signal (HE) that is input from a terminal 1007 to directly determine the current-driving time. These operations are repeated for each block to perform recording.

In a general ink-jet recording-head substrate using electrothermal transducers (heaters), when recording is repeated with heat generated by driving the heaters, the temperature of the substrate rises. In order to prevent the temperature rise from affecting the ink discharging characteristics and from worsening the recording condition, the temperature of the substrate is monitored at regular intervals, and the driving method is appropriately controlled in accordance with the temperature. In this case, the most typical method for monitoring the temperature of the substrate is to read the temperature characteristic of a voltage generated by passing a fixed current through a diode provided on the same substrate.

In general, the change of the current-voltage characteristic of the diode depending on the temperature is given by the following expression:

$$VF=(k\cdot T/q)In(IF/IS)$$

Since the characteristic is almost directly and exclusively determined by a production process of the substrate and can be estimated beforehand, the temperature of the substrate can be detected by monitoring the voltage output from the diode.

FIG. 15 is an equivalent circuit diagram of a diode conventionally used as a temperature-detecting element.

In FIG. 15, IN denotes an input-voltage terminal, OUT denotes an output-voltage terminal, and 1200 denotes a diode.

FIG. 16 is a graph showing voltage-temperature characteristics of a typical diode.

As shown in FIG. 16, the resistance of the diode decreases as the temperature rises. Therefore, when a constant current flows through the diode, the output voltage (OUT) decreases as the temperature rises, and increases as the temperature drops.

A diode serving as a temperature-detecting element is connected to a temperature output terminal (Temp) on the substrate shown in FIG. 11. The temperature of the substrate is detected by reading, from the temperature output terminal, the voltage generated by the application of a constant current to the diode. In this case, at least one temperature output terminal needs to be provided on the substrate so as to serve as an interface for external connection.

When the above-described conventional method for detecting the temperature is applied to an ink-jet recording head having a plurality of substrates, it is necessary to monitor at least one temperature output terminal provided in each of the substrates in order to detect the temperature condition of the substrate. This means that it is necessary to provide a number of signal output terminals for external connection corresponding to the number of the substrates in the recording head.

However, such an increase in number of terminals increases the number of electrical contacts in the recording head, and the area of the recording head and the number of lines are increased. Moreover, a processing circuit for separately processing the temperatures of the substrates is complicated. As a result, the costs of the recording head and a recording apparatus using the recording head are increased.

SUMMARY OF THE INVENTION

The present invention is directed to a recording head having a plurality of recording-head substrates that does not require a plurality of output terminals to separately monitor outputs from temperature-detecting elements provided in the respective substrates.

The present invention is also directed to a recording-head substrate for incorporation into the recording head and to a recording apparatus incorporating the recording head.

In one aspect of the present invention, a recording-head substrate includes a recording element, a driving circuit driving the recording element, a temperature-detecting element for measuring the temperature of the recording-head substrate, the temperature-detecting element outputting at least one of a maximum output voltage corresponding to a first temperature and a minimum output voltage corresponding to a second temperature, a first detection circuit for detecting the maximum output voltage from the temperature-detecting element, and a second detection circuit for detecting the minimum output voltage from the temperature-detecting element.

According to another aspect of the present invention, a recording head includes a plurality of recording-head substrates having the above-described features, a first output pad coupled to the first output terminals of the plurality of recording-head substrates to output a signal corresponding to a maximum one of the maximum output voltages from the first output terminals, and a second output pad coupled to the second output terminals of the plurality of recording-head substrates to output a signal corresponding to a minimum one of the minimum output voltages from the second output terminals.

According to a further aspect of the present invention, a recording apparatus includes a recording head as provided above and a control unit executing a control responsive to the signal from the recording head.

In one embodiment, the first detection circuit has an output stage including a n-channel MOS transistor. In another embodiment, the first detection circuit has an output stage including a NPN bipolar transistor. In one embodiment, the second detection circuit has an output stage including a p-channel MOS transistor. In another embodiment, the second detection circuit has an output stage including a PNP bipolar transistor.

In one embodiment, the temperature-detecting element can be a diode or a PNP transistor. In one embodiment, the first and second temperatures are minimum and maximum temperatures, respectively. In another embodiment, the first and second temperatures are maximum and minimum temperatures, respectively.

In one embodiment, the recording head is an ink-jet recording head. In this case, since the ink-jet recording head discharges ink by utilizing heat energy, in some embodiments, the recording head includes an electrothermal transducer for generating heat energy to ink.

Further features and advantages of the present invention will become apparent from the following description of the embodiments with reference to the attached drawings.

DESCRIPTION OF THE EMBODIMENTS

Embodiments of the present invention will be described in detail below with reference to the attached drawings.

In this specification, the term "recording" (also referred to as "printing") means not only forming significant information such as characters or graphics, but also forming images, designs, and patterns on a recording medium or processing a recording medium in a broad sense, whether the images and so on are significant or insignificant, or whether or not they are perceptible to human eyes.

The term "printing medium" means not only paper used in general recording apparatuses, but also materials that can receive ink, for example, fabric, plastic film, sheet metal, glass, ceramics, wood, and leather.

The term "ink" (also referred to as "liquid") should be broadly interpreted as in the above definition of "recording" ("printing"). The term "ink" means liquid that is applied onto a recording medium in order to form images, designs, and patterns on the recording medium, to process the recording medium, or to process ink (e.g., to solidify or insolubilize a coloring agent of ink applied to the recording medium).

Furthermore, the term "nozzle" is a general term for a discharging outlet, a liquid channel communicating therewith, and an element for generating energy used for ink discharging, unless otherwise specified.

Figure 1:
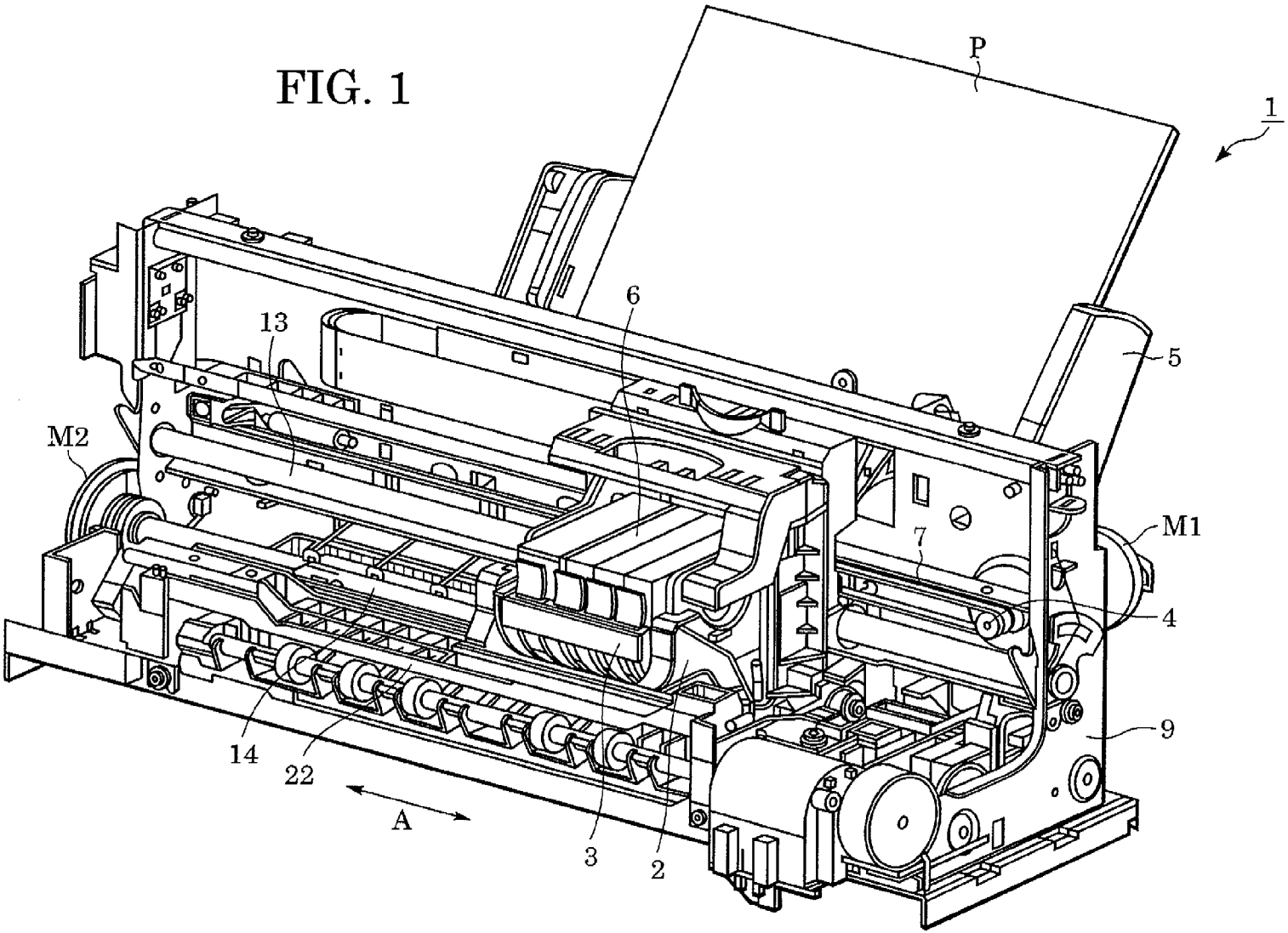
FIG. 1 is a perspective view of an ink-jet recording apparatus according to one embodiment of the present invention.

Ink-Jet Recording Apparatus (FIG. 1)

FIG. 1 is a perspective view of an ink-jet recording apparatus according to one embodiment of the present invention.

Referring to FIG. 1, an ink-jet recording apparatus (hereinafter simply referred to as a "recording apparatus") 1 includes a carriage 2, a recording head 3 mounted on the carriage 2 to perform recording by discharging ink by an ink-jet method, and a transmission mechanism 4. The carriage 2 is reciprocally moved in the direction shown by arrow A by a driving force that is generated by a carriage motor M1 and is transmitted by the transmission mechanism 4. A recording medium P, such as recording paper, is supplied by a sheet-supply mechanism 5 and is conveyed to a recording position. Recording is performed by discharging ink from the recording head 3 onto the recording medium P at the recording position.

In order to maintain the recording head 3 in good condition, a discharging recovery operation for the recording head 3 is intermittently performed in a state in which the carriage 2 is placed at a recovery unit (not shown).

Additionally, an ink cartridge 6 that stores ink to be supplied to the recording head 3 is detachably mounted on the carriage 2 of the recording apparatus 1. The ink cartridge 6 includes four independent ink cartridges.

The recording apparatus 1 is capable of color recording. For color printing, four ink cartridges 6M, 6C, 6Y, and 6K for storing magenta (M), cyan (C), yellow (Y), and black (K) inks, respectively, are mounted on the carriage 2. The four ink cartridges 6M, 6C, 6Y, and 6K are independently detachable.

Joint surfaces (contact surfaces) of the carriage 2 and the recording head 3 are in proper contact with each other to maintain a required electrical connection therebetween. For printing, the recording head 3 selectively discharges ink from a plurality of discharging outlets by the application of energy according to recording signals. In particular, in this example, the recording head 3 adopts an ink-jet recording method for discharging ink by using heat energy, and includes electrothermal transducers for generating heat energy. Electric energy applied to each electrothermal transducer is converted into heat energy, and film boiling is caused by applying the heat energy to ink. By film boiling, a bubble expands and contracts, changing the pressure of the ink. As a result, the ink is discharged from a discharging outlet due to the pressure change. The electrothermal transducers are provided corresponding to the respective discharging outlets. By applying a pulse voltage to an electrothermal transducer according to a recording signal, ink is discharged from a corresponding discharging outlet.

As shown in FIG. 1, the carriage 2 is connected to a part of a driving belt 7 of the transmission mechanism 4 that transmits a driving force of the carriage motor M1, and is guided along a guide shaft 13 to slide in the direction shown by arrow A. Therefore, the carriage 2 is reciprocally moved along the guide shaft 13 by forward and reverse rotations of the carriage motor M1.

The recording apparatus 1 also includes a platen (not shown) opposing a discharging-outlet surface of the recording head 3 on which discharging-outlets (not shown) are provided. The carriage 2 with the recording head 3 is reciprocally moved by a driving force of the carriage motor M1, and simultaneously, ink is discharged by the application of a recording signal to the recording head 3, so that recording is performed over the entire width of a recording medium P conveyed on the platen.

A feeding roller 14 for feeding a recording medium P is driven by a feeding motor M2.

Figure 2:
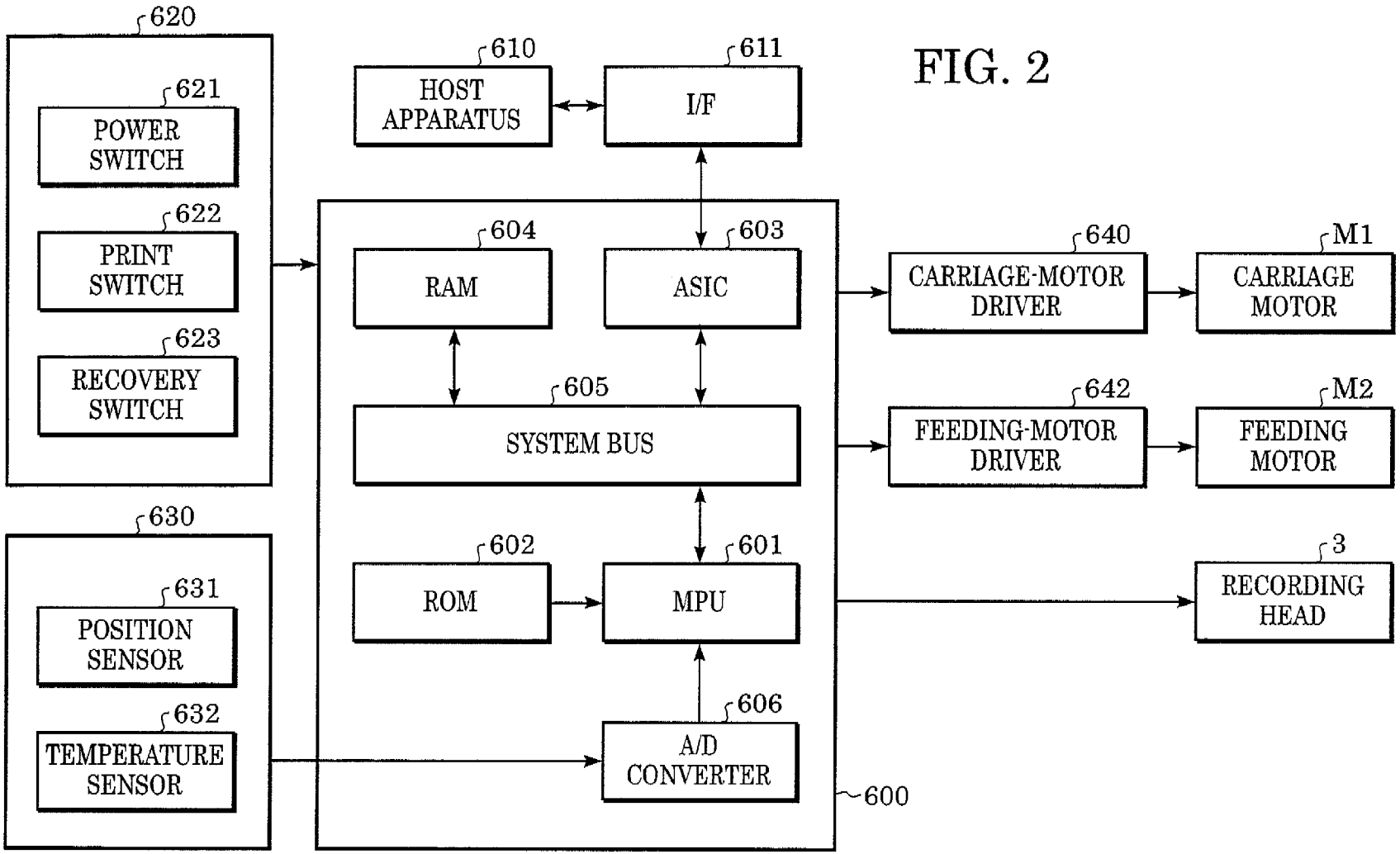
FIG. 2 is a block diagram showing the control system in the ink-jet recording apparatus shown in FIG. 1.

Control System of Ink-Jet Recording Apparatus (FIG. 2)

FIG. 2 is a block diagram showing a control system of the recording apparatus 1 shown in FIG. 1.

Referring to FIG. 2, a controller 600 includes a MPU 601, a ROM 602 that stores programs corresponding to a control sequence, which will be described later, required tables, and other fixed data, an application specific integrated circuit (ASIC) 603 that generates control signals for controlling the carriage motor M1, the feeding motor M2, and the recording head 3, a RAM 604 including, for example, an image-data expansion area and a work area for execution of programs, a system bus 605 for connecting the MPU 601, the ASIC 603, and the RAM 605 in order to achieve data exchange therebetween, and an A/D converter 606 that converts analog signals from sensors, which will be described later, to digital signals and that supplies the digital signals to the MPU 601.

A host apparatus 610 is a general term for a computer, an image reader, and a digital camera, and serves as a supply source for image data. Image data, commands, status signals, or other signals are exchanged between the host apparatus 610 and the recording apparatus 1 through an interface (I/F) 611.

A switch group 620 includes switches for receiving commands input by the user, such as a power switch 621, a print switch 622 used to start printing, a recovery switch 623 used to start a process (recovery process) for maintaining a high ink-discharging performance of the recording head 3. A sensor group 630 includes sensors for detecting the state of the recording apparatus 1, such as a position sensor, such as a photocoupler, 631 for detecting the home position h, and a temperature sensor 632 provided at an appropriate position in the recording apparatus 1 to detect the ambient temperature.

A carriage-motor driver 640 serves to drive the carriage motor M1 that reciprocally scans the carriage 2 in the direction A. A feeding-motor driver 642 serves to drive the feeding motor M2 that feeds a recording medium P.

The ASIC 603 transfers data (DATA) for driving recording elements (discharging heaters) to the recording head 3 while directly accessing a storage area of the RAM 602 during recording and scanning of the recording head 3.

The controller 600 also controls the recording head 3 and the recording apparatus 1 according to temperature information output from a temperature sensor provided in the recording head 3.

Figure 3:
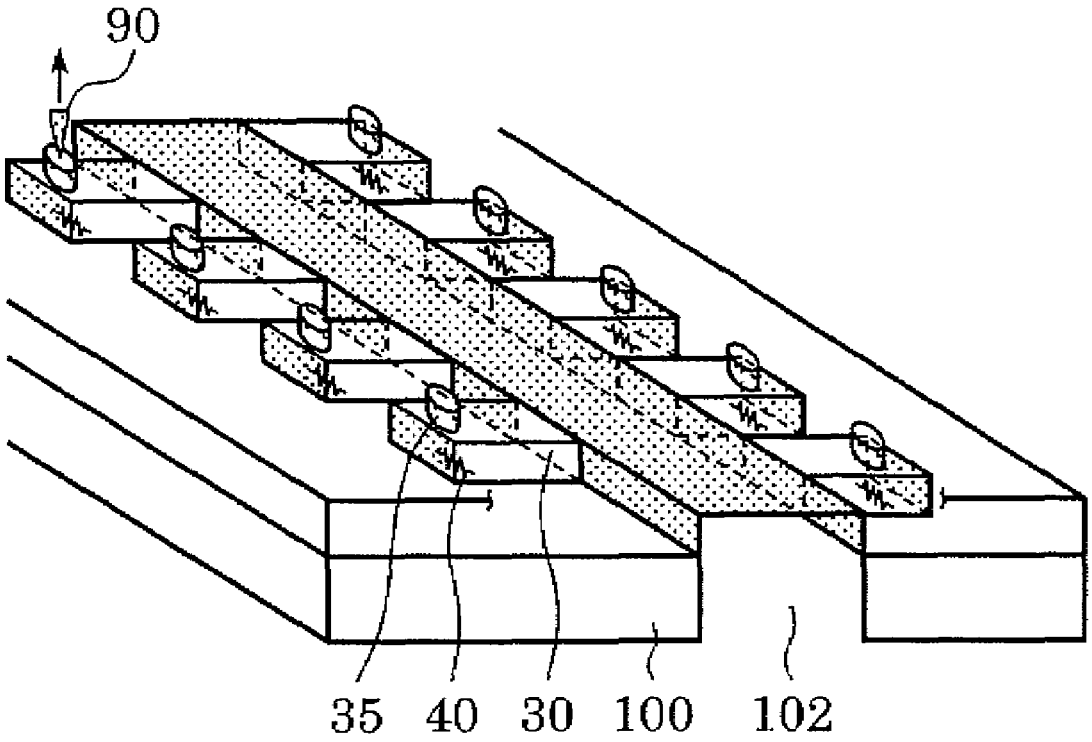
FIG. 3 is a perspective view of a section for discharging black ink in a recording head shown in FIG. 1.

Structures of Ink Channel and Ink-Discharging Outlets in Recording Head (FIG. 3)

FIG. 3 is a perspective view of a section for discharging black ink in the recording head 3 shown in FIG. 1.

FIG. 3 clearly shows the flow of black ink (K) supplied from the ink cartridge 6K. The recording head 3 includes an ink supply channel 102 for supplying black ink (K), and a supply path through which the black ink is supplied from the ink cartridge 6K to the ink supply channel 102 from the back side of a recording-head substrate (hereinafter referred to as a "head substrate") 100.

Black ink is guided to electrothermal transducers (heaters) 40 provided on the head substrate 100 through the ink supply channel 102 and ink inlets 30. When electricity is supplied to each electrothermal transducer 40 through a circuit, which will be described later, heat is applied to the ink on the electrothermal transducer 40, boiling the ink. As a result, an ink droplet 90 is discharged from a discharging outlet 35 because of a bubble produced by the boiling.

On the head substrate 100, the electrothermal transducers 40, circuits for driving the electrothermal transducers 40, memories, pads serving as electrical contacts with the carriage 2, and signal lines, which will be described in detail below, are provided.

One electrothermal transducer (heater) and a MOSFET for driving the electrothermal transducer constitute a recording element, and a plurality of recording elements constitute a recording-element unit.

While FIG. 3 shows the three-dimensional structure of the section of the recording head 3 for discharging black ink, a section for discharging the other three color inks has a similar structure. However, this structure is three times the size of the structure shown in FIG. 3 since this structure includes three ink channels.

Recording heads provided in the recording apparatus having the above-described configuration according to embodiments of the present invention will be described in detail below.

First Embodiment

Figure 4:
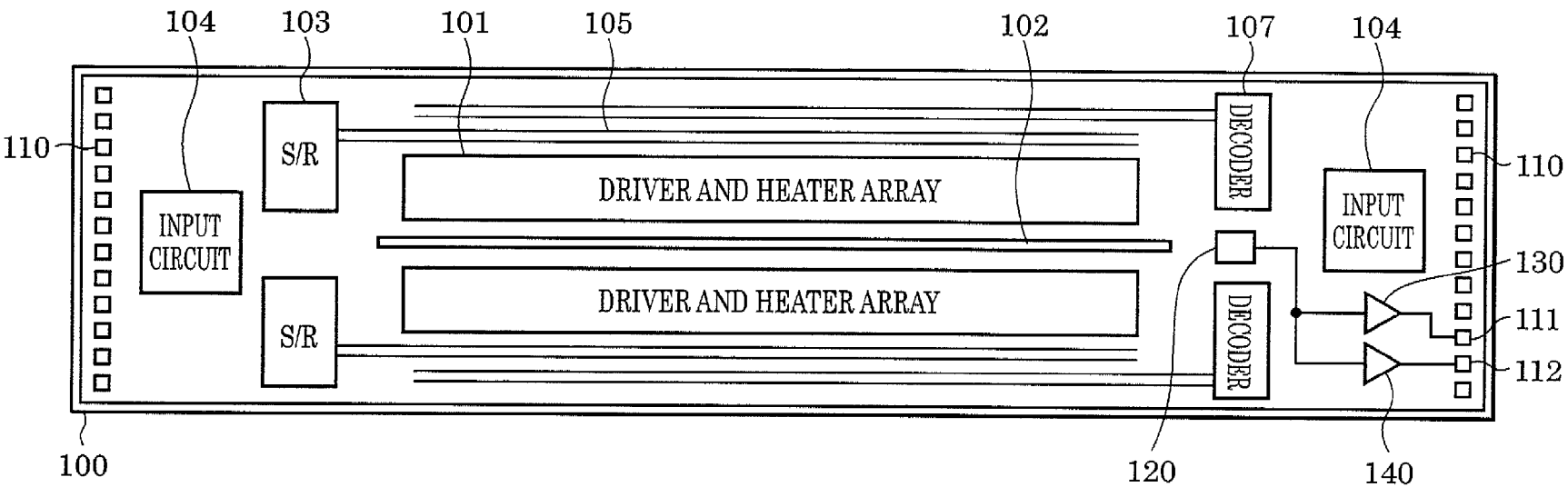
FIG. 4 is a block diagram showing the structure of an ink-jet recording-head substrate according to a first embodiment of the present invention.

FIG. 4 is a block diagram showing the configuration of an ink-jet recording-head substrate (hereinafter referred to as a "substrate") according to a first embodiment of the present invention.

Figure 11:
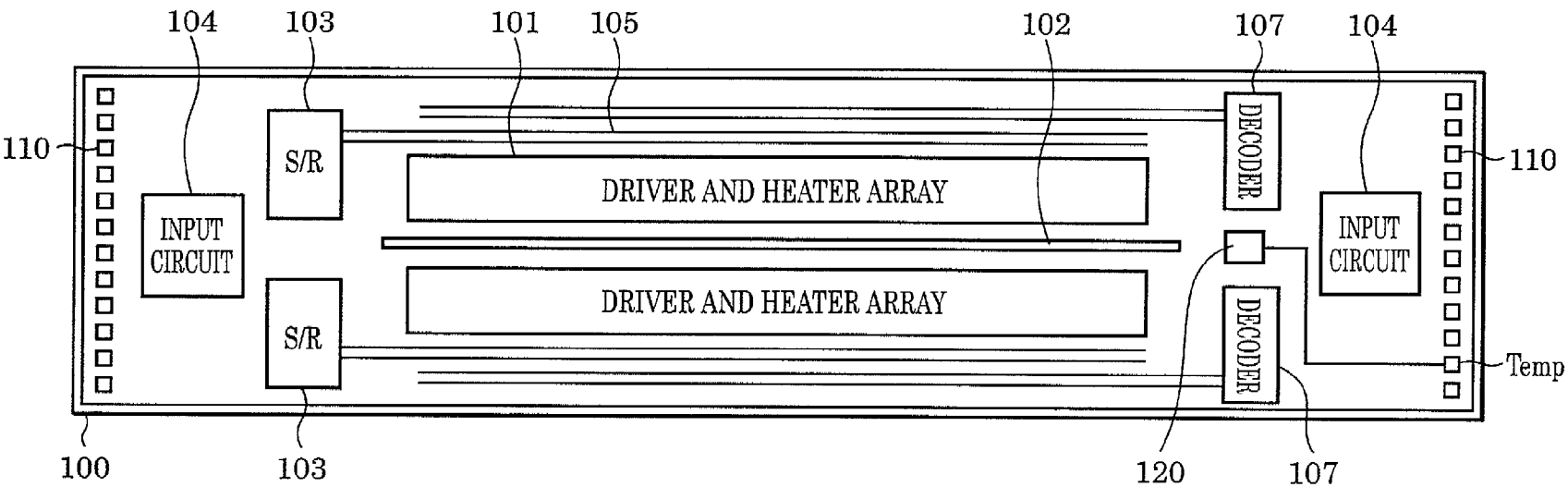
FIG. 11 (PRIOR ART)
FIG. 11 is a block diagram showing the structure of a known ink-jet recording head having a temperature-detecting element.
Figure 12:
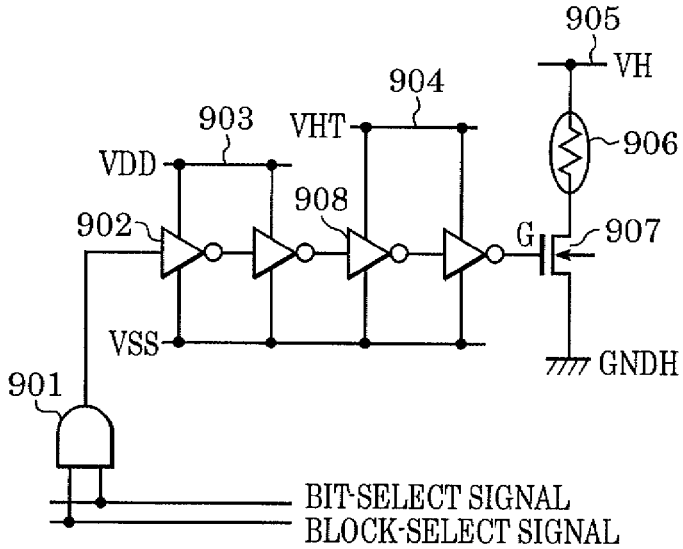
FIG. 12 (PRIOR ART)
FIG. 12 is an equivalent diagram of a circuit used to drive one driver (one segment) in order to supply power to a heater for ink discharging.
Figure 13:
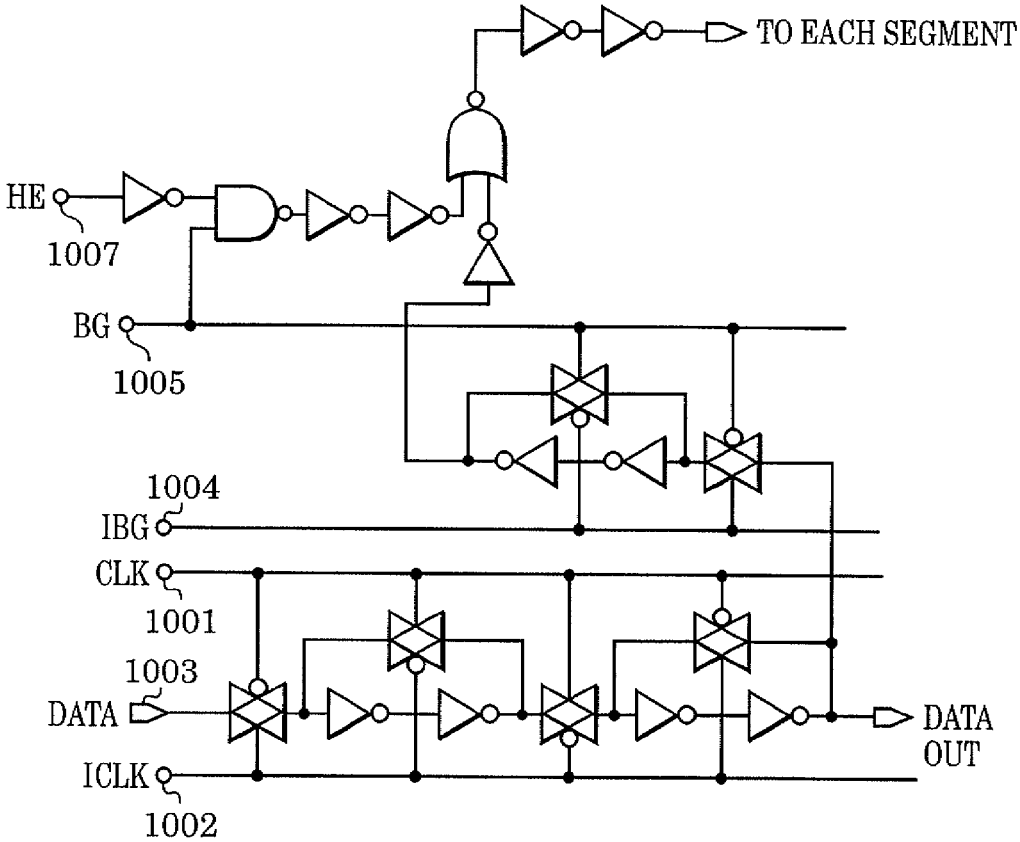
FIG. 13 (PRIOR ART)
FIG. 13 is an equivalent diagram of a circuit corresponding to one bit of a shift resister (S/R) and a latch circuit for temporarily storing recording data.
Figure 14:
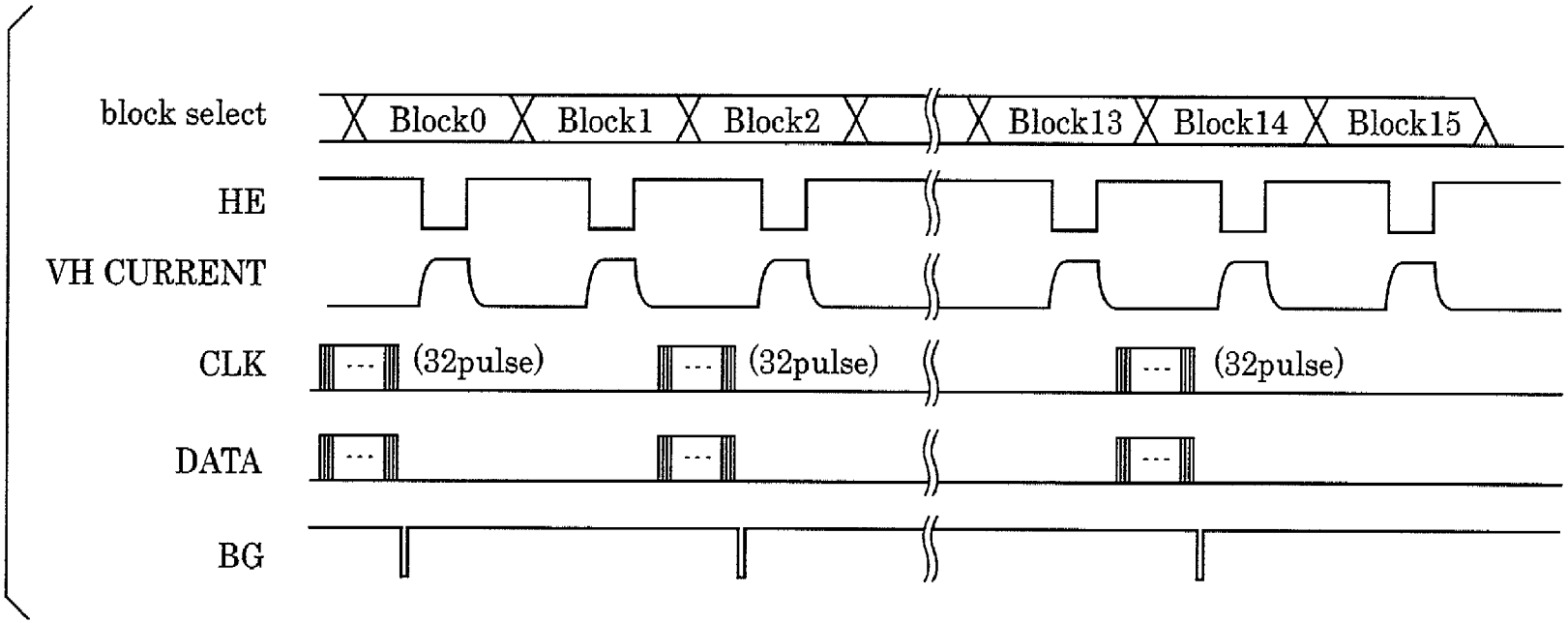
FIG. 14 (PRIOR ART)
FIG. 14 is a timing chart showing a series of operations of transferring recording data to the shift resister (S/R) and of supplying a current to the heater.
Figure 15:
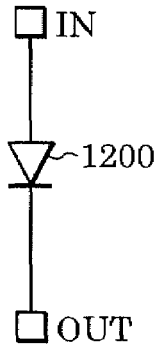
FIG. 15 (PRIOR ART)
FIG. 15 is an equivalent circuit diagram of a diode used as a known temperature-detecting element.
Figure 16:
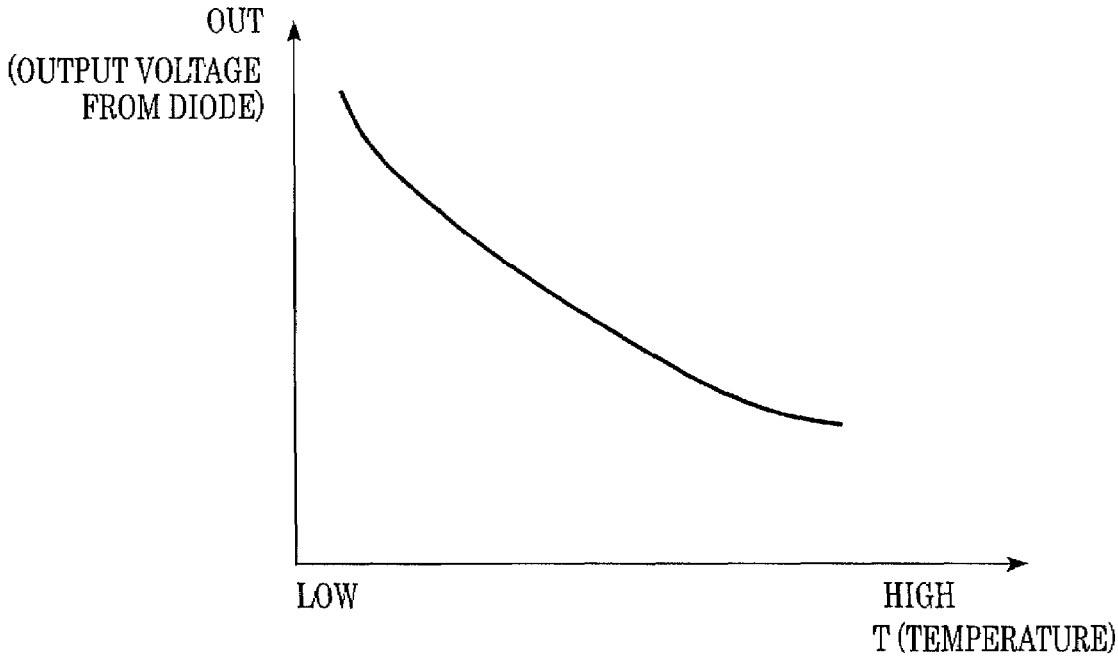
FIG. 16 (PRIOR ART)
FIG. 16 is a voltage-to-temperature characteristic view of a typical diode.

In FIG. 4, the same components as those described with reference to FIG. 11 are denoted by the same reference numerals, and descriptions thereof are omitted. Only characteristic components in the first embodiment will be described below.

A buffer circuit 130 is used to detect the minimum voltage (maximum temperature) of the voltage outputs from a plurality of temperature sensors provided in the recording head as a whole, as will be described later with reference to FIG. 8. A buffer circuit 140 is used to detect the maximum voltage (minimum temperature) of the voltage outputs from the temperature sensors provided in the recording head, as will be similarly described later with reference to FIG. 8. Outputs (Temp(max) and Temp(min)) from the two buffer circuits 130 and 140 are connected to an output terminal 111 and an output terminal 112, respectively.

Figure 5:
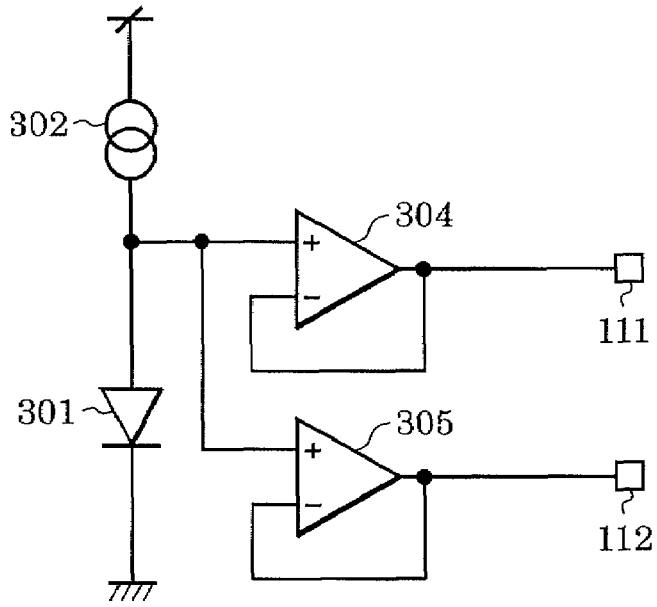
FIG. 5 is a circuit diagram showing a detailed structure of a section defined by a temperature-detecting circuit and buffer circuits.

FIG. 5 is a circuit diagram showing a detailed configuration of a circuit constituted by a temperature-detecting circuit 120 and the buffer circuits 130 and 140.

Figure 8:
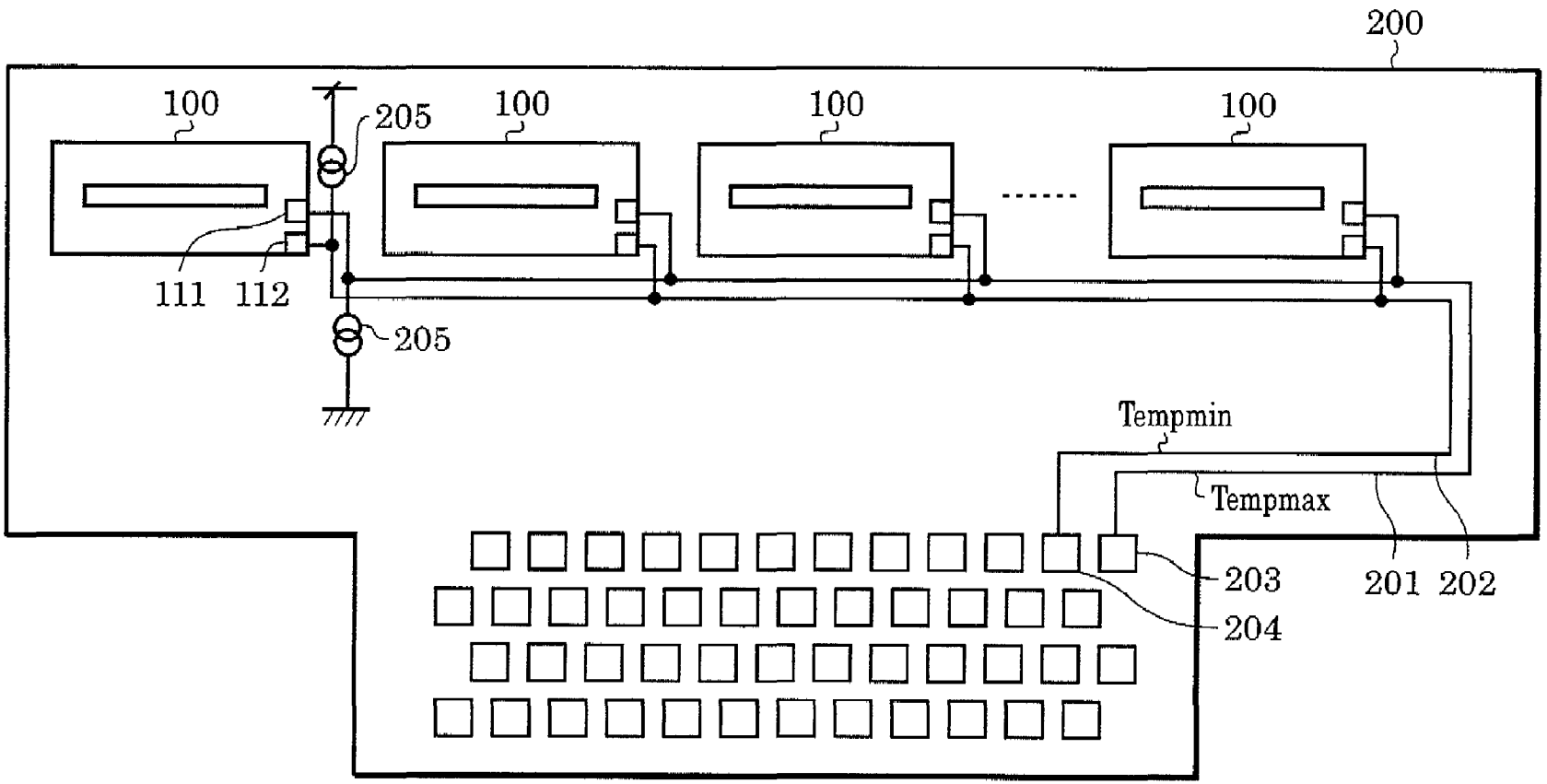
FIG. 8 is an explanatory view showing the configuration of a recording head in which a plurality of substrates according to the first embodiment are provided.

The circuit shown in FIG. 5 includes a diode 301 serving as a temperature-detecting element (sensor) having a current-voltage characteristic that is directly and exclusively determined by the temperature, a power supply 302 for supplying a constant current to the diode 301, and the buffer circuits 304 and 305 used to detect the minimum voltage (maximum temperature) and the maximum voltage (minimum temperature) of the voltage outputs from a plurality of temperature sensors provided in the recording head, as will be described with reference to FIG. 8.

Since the buffer circuits 304 and 305 respectively detect the minimum voltage and the maximum voltage, they are slightly different in the internal circuit configuration.

Figure 6:
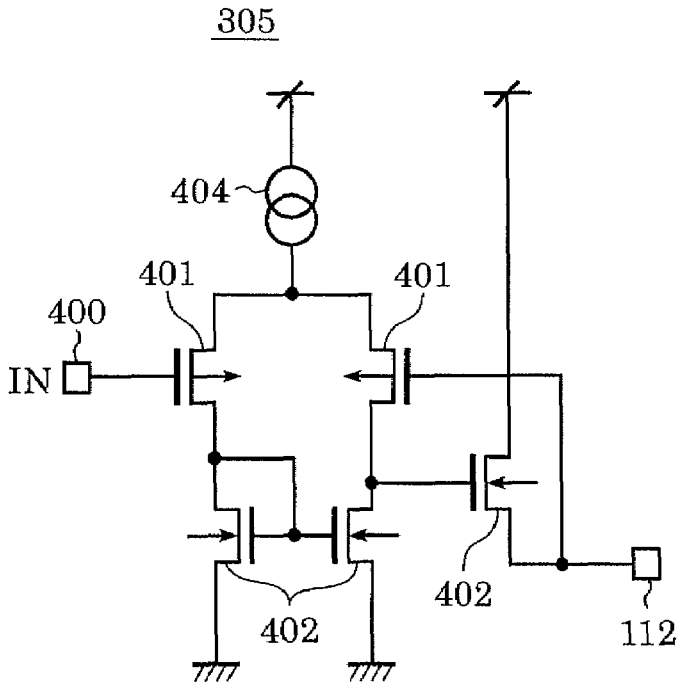
FIG. 6 is a circuit diagram of a buffer circuit for detecting the maximum voltage (minimum temperature).

FIG. 6 shows the configuration of the buffer circuit 305 used to detect the maximum voltage (minimum temperature). Similarly, FIG. 7 shows the configuration of the buffer circuit 304 used to detect the minimum voltage (maximum temperature).

Figure 7:
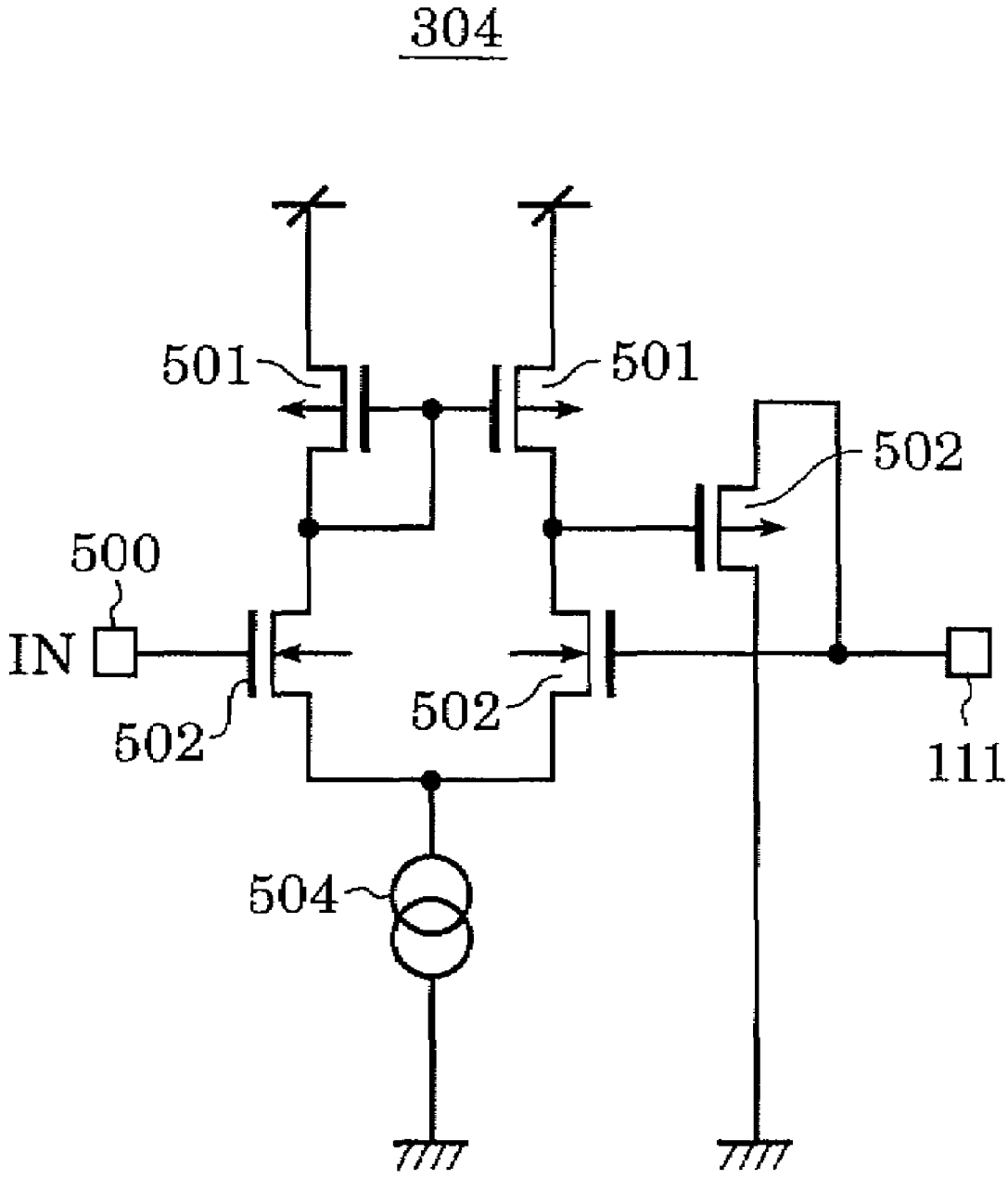
FIG. 7 is a circuit diagram of a buffer circuit for detecting the minimum voltage (maximum temperature).

In FIGS. 6 and 7, reference numerals 400 and 500 denote input terminals for the buffer circuits 305 and 304, 401 and 501 denote p-channel MOS transistors, 402 and 502 denote n-channel MOS transistors, and 404 and 504 denote power supplies for supplying a bias current.

FIG. 8 shows the configuration of a recording head in which a plurality of substrates 100 according to the first embodiment are arranged. In this configuration, a plurality of temperature-detecting circuits are provided.

The recording head shown in FIG. 8 includes a head base 200 on which a plurality of substrates 100 are arranged, output terminals 111 and 112 of buffer circuits 130 and 140 used to detect the minimum and maximum voltages of a diode, a line 201 for connecting the output terminals 111 of the substrates 100, a line 202 for connecting the output terminals 112 of the substrates 100, an output pad 203 for the line 201, an output pad 204 for the line 202, and load-current supplies 205 connected to the connecting lines 201 and 202.

In the above-described configuration, two buffer circuits are provided in each of the substrates 100, as shown in FIGS. 4 and 5. In one of the buffer circuits for detecting the maximum voltage (minimum temperature), the output stage has a so-called source follower output configuration in which a voltage is output from a source of an n-channel MOS transistor, as shown in FIG. 6. In the other buffer circuit for detecting the minimum voltage (maximum temperature), the output stage has a so-called source follower output configuration in which a voltage is output from a source of a p-channel MOS transistor, as shown in FIG. 7. Outputs from the buffer circuits are connected on the head base 200, and a load is applied thereto from the power supplies 205, as shown in FIG. 8. In this circuit configuration (configuration shown in FIG. 6), for example, when a terminal 112 provided in a certain substrate for outputting a voltage receives a lower voltage from another substrate, the n-channel MOS transistor 402 of the certain substrate is turned off. Therefore, only the maximum voltage of the outputs from the head substrates is output to the connecting line without causing any interference.

In the circuit for detecting the minimum voltage shown in FIG. 7, similarly, only the minimum voltage of the outputs from the head substrates is output.

In the above-described configuration, the minimum voltage of the output voltages from the output terminals 111 of the substrates 100 is output from the output pad 203, and the maximum voltage of the output voltages from the output terminals 112 of the substrates 100 is output from the output pad 204.

As described above, according to the first embodiment, it is possible to obtain the minimum voltage and the maximum voltage of the voltage outputs from a plurality of diodes provided as the temperature-detecting circuits in the recording head, i.e., the voltage corresponding to the substrate having the lowest temperature of the recording-head substrates and the voltage corresponding to the substrate having the highest temperature.

Second Embodiment

When the size of the substrate is increased, for example, because the number of heaters increases or a number of heater arrays corresponding to a plurality of inks are provided, a plurality of temperature-detecting circuits are sometimes provided on the same substrate. A description will now be given of that case in which a plurality of temperature-detecting circuits are provided on the same substrate.

Figure 9:
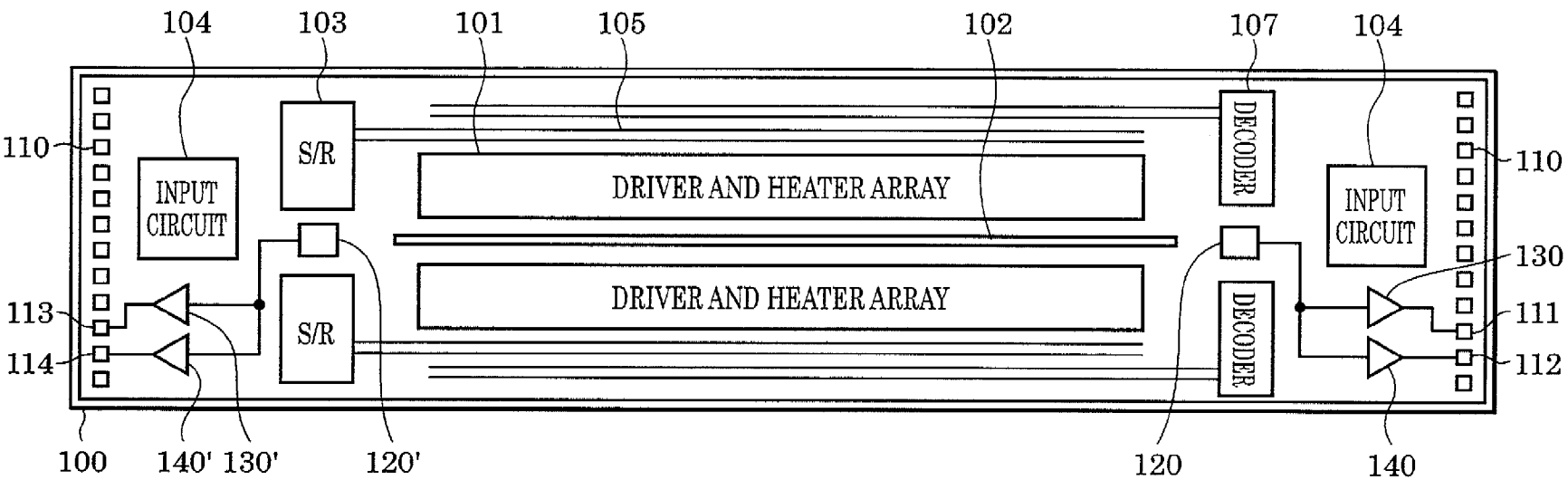
FIG. 9 is a block diagram showing the structure of an ink-jet recording-head substrate according to a second embodiment of the present invention.

FIG. 9 is a block diagram showing the configuration of an ink-jet recording-head substrate (hereinafter simply referred to as a "substrate") according to a second embodiment of the present invention.

In FIG. 9, the same components as those described with reference to FIGS. 4 and 11 are denoted by the same reference numerals, and descriptions thereof are omitted. Only characteristic components in the second embodiments will be described below.

While the temperature-detecting circuit, the buffer circuits, and the output terminals are provided on only one end of the substrate 100 in the first embodiment, in the second embodiment, a temperature-detecting circuit 120, two buffer circuits 130 and 140, and output terminals 111 and 112 are provided on one end of a substrate 100, and a temperature-detecting circuit 120', two buffer circuits 130' and 140', and output terminals 113 and 114 are similarly provided on the other end.

Figure 10:
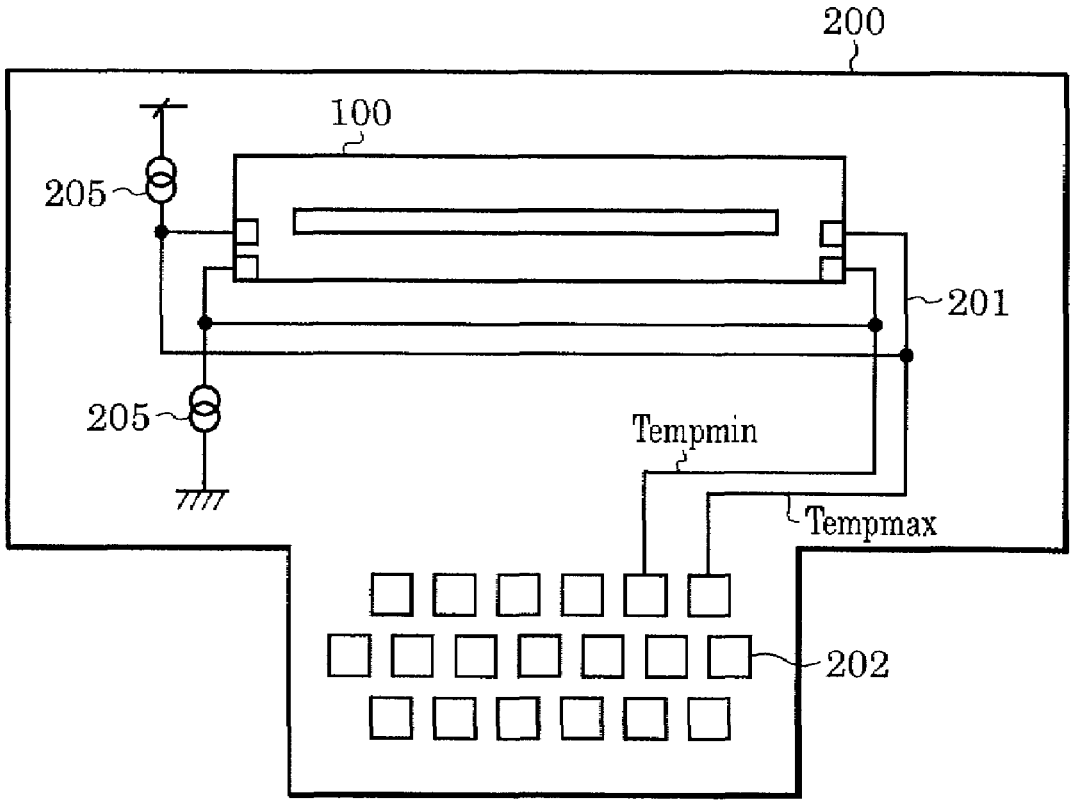
FIG. 10 is an explanatory view showing the configuration of an ink-jet recording head having the substrate of the second embodiment.

FIG. 10 shows the configuration of a recording head including the substrate 100 of the second embodiment. In FIG. 10, the same components as those in FIG. 8 are denoted by the same reference numerals, and therefore, descriptions thereof are omitted.

In the second embodiment, in a manner similar to that in the first embodiment, buffer circuits are added to each of the temperature-detecting circuits, and are connected to each other and to load-current supplies on a head base, as shown in FIG. 10. Although it is impossible to precisely detect the position on the head substrate corresponding to the temperature, it is possible to obtain the minimum and maximum voltages of the voltage outputs from diodes used in the temperature-detecting circuits, i.e., the voltage corresponding to a position having the lowest temperature and the voltage corresponding to a position having the highest temperature on the same substrate.

By combining the first and second embodiments, that is, by using a recording head base including a plurality of substrates each having a plurality of temperature-detecting circuits, advantages similar to those obtained by the first and second embodiment can be provided.

While the MOS transistors are used in the buffer circuits in the above-described embodiments, alternatively, bipolar transistors may be used or both MOS transistors and bipolar transistors may be used as long as the buffer circuits can provide similar advantages.

More specifically, while an n-channel MOS transistor is provided in an output stage of each of the buffer circuits 140 and 140' for outputting the maximum voltage, as shown in FIG. 6, an NPN bipolar transistor may be provided instead. Similarly, while a p-channel MOS transistor is provided in an output stage of each of the buffer circuits 130 and 130' for outputting the minimum voltage, as shown in FIG. 7, a PNP bipolar transistor may be provided instead.

In this case, the output stages of the buffer circuits 140 and 140' for outputting the maximum voltage have a so-called emitter follower output configuration in which a voltage is output from an emitter of the NPN bipolar transistor, and the output stages of the buffer circuits 130 and 130' for outputting the minimum voltage have a so-called emitter follower configuration in which a voltage is output from an emitter of the PNP bipolar transistor. Since output impedances of the buffer circuits are separated by the emitter followers, they do not interfere with each other, and a required voltage is output to the connecting line. As a result, similar advantages can be provided.

While diodes are used as the temperature-detecting elements in the above-described embodiments, they may be replaced with, for example, PNP transistors. Furthermore, the above embodiments describe the temperature-detecting elements outputting a maximum voltage corresponding to a minimum temperature and outputting a minimum voltage corresponding to a maximum temperature. Alternatively, the temperature-detecting elements can output a maximum voltage corresponding to a maximum temperature and output a minimum voltage corresponding to a minimum temperature. Further still, the temperature-detecting element can output a first signal corresponding to a first temperature and output a second signal corresponding to a second temperature.

While the buffer circuits are provided together with the heater and the circuit for driving the heater on the same substrate, similar advantages can be achieved by placing a separate member having buffer circuits in the recording head.

In the above-described embodiments, it is impossible to obtain information as to which substrate has the minimum temperature or the maximum temperature. However, since at least the maximum temperature and the minimum temperature in the recording head can be detected, important information necessary to control the recording head can be obtained with a simple circuit configuration.

While the ink-jet recording head uses heat energy generated by the heaters in the above-described embodiments, the present invention is also applicable to a thermal transfer recording head using heaters as recording elements, and to an ink-jet recording head using, for example, piezoelectric elements.

While ink is discharged in the form of droplets from the recording head and is stored in the ink tank in the above-described embodiments, for example, the ink tank may store a processing liquid to be discharged onto a recording medium in order to enhance fixability and water resistance of a recorded image and to improve image quality.

In particular, the ink-jet recording apparatus of the above-described embodiments includes means (e.g., electrothermal transducers or laser light) for generating heat energy used to discharge ink, and adopts a recording method that causes a change in the state of the ink by the heat energy. According to this recording method, high-density, high-precision printing can be achieved.

The typical arrangement and principle of the ink-jet recording apparatus are preferably referred to the basic principle disclosed in, for example, U.S. Pat. Nos. 4,723,129 and 4,740,796. While this principle is applicable to both so-called on-demand recording and continuous recording, it is effective particularly in on-demand recording. This is because heat energy is generated by each of the electrothermal transducers, which are provided corresponding to a sheet or liquid channels holding liquid (ink), by applying at least one driving signal, which corresponds to recording information and causes a rapid temperature rise exceeding nucleate boiling, to the electrothermal transducer. Film boiling is caused on a heat-acting surface of the recording head by the heat energy, and consequently, a bubble can be formed in the liquid in one-to-one correspondence with the driving signal. By discharging the liquid through a discharging opening by the expansion and contraction of the bubble, at least one drop is formed. The driving signal can be in a pulse form, because the bubble is immediately and properly expanded and contracted, and the liquid can be discharged with a particularly high responsiveness.

While the recording apparatus of the above-embodiments is of a serial type in which recording is performed by scanning the recording head, the present invention is also applicable to a full-line recording apparatus that uses a recording head having a length corresponding to the width of a recording medium. The full-line recording apparatus may include a plurality of recording heads combined in accordance with the length, as disclosed in the above publication, or may include a single recording head.

In addition, not only a cartridge-type recording head in which an ink tank is provided integrally with the recording head, as in the above embodiments, but also an exchangeable chip-type recording head that is mounted in the main body of the apparatus to establish an electrical connection to the main body and to supply ink from the main body may be used.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording head comprising:

a first recording-head substrate and a second recording-head substrate, wherein each of the first and second recording-head substrates comprises:

a recording element;

a driving circuit driving the recording element;

a temperature-detecting element measuring a temperature of the recording-head substrate, the temperature-detecting element outputting a voltage corresponding to temperature;

a first detection circuit outputting the output voltage from the temperature-detecting element;

a second detection circuit outputting the output voltage from the temperature-detecting element;

a first output terminal coupled to the first detection circuit to output the first signal from the first detection circuit; and a second output terminal coupled to the second detection circuit to output the second signal from the second detection circuit;

a first current supply;

a second current supply;

a first output pad coupled to the first current supply, the first output terminal of the first recording-head substrate, and the first output terminal of the second recording-head substrate; and a second output pad coupled to the second current supply, the second output terminal of the first recording-head substrate, and the second output terminal of the second recording-head substrate, wherein the first detection circuit has an output stage including an n-channel MOS transistor and outputs from a source of the n-channel MOS transistor, and wherein the second detection circuit has an output stage including a p-channel MOS transistor and outputs from a source of the p-channel MOS transistor.

2. The recording head according to claim 1, wherein the temperature-detecting element includes a diode.

3. A recording apparatus which records on a recording medium by using a recording-head according to claim 1.

* * * * *